US012246809B2

(12) United States Patent
Kasai et al.

(10) Patent No.: US 12,246,809 B2
(45) Date of Patent: Mar. 11, 2025

(54) VESSEL PROPULSION APPARATUS, VESSEL, VESSEL ENGINE, AND EXHAUST STRUCTURE OF VESSEL ENGINE

(71) Applicant: YAMAHA HATSUDOKI KABUSHIKI KAISHA, Iwata (JP)

(72) Inventors: Shinya Kasai, Shizuoka (JP); Koichi Nakayama, Shizuoka (JP); Jiro Fukuoka, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 225 days.

(21) Appl. No.: 17/969,846

(22) Filed: Oct. 20, 2022

(65) Prior Publication Data

US 2023/0150635 A1 May 18, 2023

(30) Foreign Application Priority Data

Nov. 15, 2021 (JP) ..... 2021-185987

(51) Int. Cl.
*B63H 20/24* (2006.01)
*F01N 13/10* (2010.01)

(52) U.S. Cl.
CPC ..... *B63H 20/245* (2013.01); *F01N 13/10* (2013.01)

(58) Field of Classification Search
CPC ..... B63H 20/245; F01N 3/10; F01N 3/2892; F01N 13/10; F01N 13/004; F01N 13/08; F01N 13/1805; F01N 13/18; F01N 2590/02; F01N 2590/021; F01N 2590/04; B60K 13/04; Y02A 50/20; Y02T 10/12
See application file for complete search history.

(56) References Cited

U.S. PATENT DOCUMENTS 5,816,045 A * 10/1998 Blocker ..... F01N 13/10 60/323
7,171,805 B2 * 2/2007 Ruehle ..... F01N 13/10 60/322
7,832,205 B2 * 11/2010 Ruehle ..... F01N 13/10 60/323
8,944,870 B1 * 2/2015 Ochiai ..... F01N 13/12 440/89 R
10,837,353 B2 * 11/2020 Iwakiri ..... F02M 35/10091
2005/0205028 A1 * 9/2005 Lewis ..... F02D 41/221 123/90.11
2008/0057803 A1 * 3/2008 Ozaki ..... F01N 13/02 440/89 C
2014/0242859 A1 8/2014 Ochiai

FOREIGN PATENT DOCUMENTS

JP 2020-101090 A 7/2020

* cited by examiner

*Primary Examiner* — Dapinder Singh
(74) *Attorney, Agent, or Firm* — Keating & Bennett, LLP

(57) ABSTRACT

A vessel propulsion apparatus includes an engine and a propulsion unit to be driven by the engine. The engine includes cylinders arranged in series, exhaust ports respectively connected to combustion chambers of the cylinders and curved in a predetermined downstream direction to allow exhaust gases to flow out from the combustion chambers, and a collecting exhaust pipe. The collecting exhaust pipe is integral with the exhaust ports, and extends in the downstream direction to allow exhaust gases in the exhaust ports to flow in the downstream direction. At least one of a plurality of connector portions that individually connect the exhaust ports to the collecting exhaust pipe includes a concave portion at an inner surface thereof.

14 Claims, 7 Drawing Sheets

VESSEL PROPULSION APPARATUS, VESSEL, VESSEL ENGINE, AND EXHAUST STRUCTURE OF VESSEL ENGINE

CROSS REFERENCE TO RELATED APPLICATIONS

This application claims the benefit of priority to Japanese Patent Application No. 2021-185987 filed on Nov. 15, 2021. The entire contents of this application are hereby incorporated herein by reference.

BACKGROUND OF THE INVENTION

1. Field of the Invention

The present invention relates to a vessel propulsion apparatus, a vessel, a vessel engine, and an exhaust structure of a vessel engine.

2. Description of the Related Art

U.S. 2014/0242859 A1 discloses an outboard motor that is an example of a vessel propulsion apparatus. An engine for use in the outboard motor includes a plurality of cylinders, a cylinder head attached to the cylinders, and an exhaust pipe. The cylinder head includes a plurality of combustion chambers respectively corresponding to the plurality of cylinders, and a pair of exhaust ports connected to each of the combustion chambers. The exhaust pipe is connected to each of the exhaust ports. The exhaust pipe guides exhaust gases discharged from each of the combustion chambers through the exhaust port.

SUMMARY OF THE INVENTION

In a vessel propulsion apparatus, such as the outboard motor disclosed in U.S. 2014/0242859 A1, there is a case in which the exhaust port and the exhaust pipe are integral with each other in order to make the engine compact. In this case, there is a possibility that exhaust pressure loss will increase because of a structure in which exhaust gases that have flowed out from each of the combustion chambers to each of the exhaust ports immediately reach the exhaust pipe. An increase in exhaust pressure loss is a factor that lowers engine performance, and therefore it is preferable to achieve a decrease in exhaust pressure loss.

Preferred embodiments of the present invention provide vessel propulsion apparatuses each able to achieve a decrease in exhaust pressure loss of an engine, vessels including the vessel propulsion apparatuses, vessel engines included in the vessel propulsion apparatuses, and exhaust structures of the vessel engines.

The inventor of preferred embodiments of the present invention described and claimed in the present application conducted an extensive study and research regarding a vessel propulsion apparatus, a vessel, a vessel engine, and an exhaust structure of a vessel engine, such as the one described above, and in doing so, discovered and first recognized new unique challenges and previously unrecognized possibilities for improvements as described in greater detail below.

In order to overcome the previously unrecognized and unsolved challenges described above, a preferred embodiment of the present invention provides a vessel propulsion apparatus including an engine and a propulsion unit to be driven by the engine. The engine includes a plurality of cylinders arranged in series and each including a combustion chamber, a plurality of exhaust ports respectively connected to the combustion chambers of the plurality of cylinders and curved in a predetermined downstream direction to allow exhaust gases to flow out from the combustion chambers, and a collecting exhaust pipe. The collecting exhaust pipe is integral with the plurality of exhaust ports and extends in the downstream direction to allow exhaust gases in the exhaust ports to flow in the downstream direction. At least one of a plurality of connector portions that individually connect the plurality of exhaust ports to the collecting exhaust pipe includes a concave portion at an inner surface thereof.

With this structural arrangement, in the vessel propulsion apparatus, the propulsion unit is driven when the engine generates a driving force, and therefore the vessel propulsion apparatus generates a thrust. In the engine, the plurality of exhaust ports respectively connected to the combustion chambers of the plurality of cylinders arranged in series and the collecting exhaust pipe are integral with each other, thus making it possible to make the engine compact. The exhaust ports allow exhaust gases discharged from the corresponding combustion chambers to flow in the same direction, i.e., in a downstream direction, and the collecting exhaust pipe allows exhaust gases in each of the exhaust ports to continuously flow in the downstream direction. The concave portion provided at the inner surface in the at least one of the plurality of connector portions that individually connect the exhaust ports to the collecting exhaust pipe allows exhaust gases in the at least one of the plurality of connector portions to flow in the downstream direction, thus enabling the exhaust gases from each of the exhaust ports to smoothly flow toward the collecting exhaust pipe in the downstream direction. This makes it possible to achieve a decrease in exhaust pressure loss of the engine.

In a preferred embodiment of the present invention, each of the plurality of exhaust ports includes an upstream portion connected to the combustion chamber and a downstream portion that is curved from the upstream portion in the downstream direction and that is connected to the collecting exhaust pipe. The concave portion includes a first concave portion located at an inner surface of the downstream portion.

With this structural arrangement, the first concave portion provided at the inner surface of the downstream portion allows exhaust gases in the downstream portion to flow in the downstream direction, and therefore it is possible to allow exhaust gases from each of the exhaust ports to smoothly flow toward the collecting exhaust pipe in the downstream direction.

In a preferred embodiment of the present invention, the first concave portion is located in a region of the inner surface of the downstream portion that is more distant from a center of curvature of the downstream portion than a central axis of the downstream portion.

With this structural arrangement, the first concave portion allows exhaust gases in the downstream portion of the exhaust port to effectively flow in the downstream direction, and therefore it is possible to allow exhaust gases from each of the exhaust ports to flow toward the collecting exhaust pipe in the downstream direction more smoothly.

In a preferred embodiment of the present invention, the exhaust port includes a pair of exhaust ports for each of the cylinders. The pair of exhaust ports include an upstream exhaust port and a downstream exhaust port located at a more downward location in the downstream direction than the upstream exhaust port. The downstream portion of the upstream exhaust port and the downstream portion of the downstream exhaust port are merged together. The first concave portion is located in a region of an inner surface of the downstream portion of the upstream exhaust port that is more distant from a center of curvature of the downstream portion of the upstream exhaust port than a central axis of the downstream portion of the upstream exhaust port.

With this structural arrangement, the first concave portion allows exhaust gases in the merging portion of the downstream portion of the upstream exhaust port and the downstream portion of the downstream exhaust port to effectively flow in the downstream direction, and therefore it is possible to allow exhaust gases from each of the exhaust ports to flow toward the collecting exhaust pipe in the downstream direction more smoothly.

In a preferred embodiment of the present invention, the plurality of cylinders include a first cylinder located at a top in a direction opposite to the downstream direction and a second cylinder adjacent to the first cylinder. The first concave portion located at the exhaust port connected to the combustion chamber of the second cylinder is larger than the first concave portion located at the exhaust port connected to the combustion chamber of any cylinder other than the second cylinder of the plurality of cylinders.

With this structural arrangement, the first concave portion provided at the exhaust port connected to the combustion chamber of the second cylinder allows exhaust gases in the downstream portion of this exhaust port to effectively flow in the downstream direction so as not to flow toward the exhaust port side connected to the combustion chamber of the first cylinder, i.e., so as not to flow in the opposite direction. Therefore, it is possible to allow exhaust gases from the exhaust port connected to the combustion chamber of the second cylinder to flow toward the collecting exhaust pipe in the downstream direction more smoothly.

In a preferred embodiment of the present invention, each of the plurality of exhaust ports includes an upstream portion connected to the combustion chamber and a downstream portion that is curved from the upstream portion in the downstream direction and connected to the collecting exhaust pipe. The concave portion includes a second concave portion located in a region of an inner surface of the collecting exhaust pipe that is adjacent to the downstream portion.

With this structural arrangement, the second concave portion provided in a region of the inner surface of the collecting exhaust pipe that is adjacent to the downstream portion of each of the exhaust ports allows exhaust gases in this region to effectively flow in the downstream direction so as not to flow toward the exhaust port located farther downstream than this region. Therefore, exhaust gases that have flowed into the collecting exhaust pipe from each of the exhaust ports are allowed to continuously flow to the collecting exhaust pipe, thus enabling the exhaust gases to smoothly flow in the downstream direction.

In a preferred embodiment of the present invention, the second concave portion is located in a region of the inner surface of the collecting exhaust pipe that is closer to the exhaust port than a central axis of the collecting exhaust pipe.

With this structural arrangement, the second concave portion allows exhaust gases existing in a region of the inner surface of the collecting exhaust pipe that is adjacent to the downstream portion of each of the exhaust ports to flow in the downstream direction more effectively so as not to flow toward the exhaust port located farther downstream than this region. Therefore, exhaust gases that have flowed into the collecting exhaust pipe from each of the exhaust ports are allowed to continuously flow to the collecting exhaust pipe, thus enabling the exhaust gases to flow in the downstream direction more smoothly.

In a preferred embodiment of the present invention, the plurality of cylinders include a first cylinder located at a top in a direction opposite to the downstream direction of any other cylinder. The second concave portion, located in a region of the inner surface of the collecting exhaust pipe that is adjacent to the downstream portion of the exhaust port connected to the combustion chamber of the first cylinder, is larger than the second concave portion located in a region adjacent to the downstream portion of an exhaust port connected to the combustion chamber of each of the other cylinders.

With this structural arrangement, the second concave portion provided in a region of the inner surface of the collecting exhaust pipe that is adjacent to the downstream portion of the exhaust port connected to the combustion chamber of the first cylinder allows exhaust gases in this region to effectively flow in the downstream direction so as not to backwardly flow to the exhaust port of the first cylinder. Therefore, exhaust gases that have flowed into the collecting exhaust pipe from the exhaust port of the first cylinder are allowed to continuously flow to the collecting exhaust pipe, thus enabling the exhaust gases to smoothly flow in the downstream direction.

A preferred embodiment of the present invention provides a vessel propulsion apparatus that includes an engine and a propulsion unit to be driven by the engine. The engine includes a plurality of cylinders arranged in series and each including a combustion chamber, a plurality of exhaust ports respectively connected to the combustion chambers of the plurality of cylinders and curved in a predetermined downstream direction to allow exhaust gases to flow out from the combustion chambers, and a collecting exhaust pipe. The collecting exhaust pipe is integral with the plurality of exhaust ports and extends in the downstream direction to allow exhaust gases in the exhaust ports to flow in the downstream direction. At least one of a plurality of connector portions that individually connect the plurality of exhaust ports to the collecting exhaust pipe includes a guide at an inner surface thereof to direct exhaust gases in the at least one of the plurality of connector portions in the downstream direction.

With this structural arrangement, in the vessel propulsion apparatus, the propulsion unit is driven when the engine generates a driving force, and therefore the vessel propulsion apparatus generates a thrust. In the engine, the plurality of exhaust ports respectively connected to the combustion chambers of the plurality of cylinders arranged in series and the collecting exhaust pipe are integral with each other, thus making it possible to make the engine compact. The exhaust ports allow exhaust gases discharged from the corresponding combustion chambers to flow in the same direction, i.e., in a downstream direction, and the collecting exhaust pipe allows exhaust gases in each of the exhaust ports to continuously flow in the downstream direction. The guide provided at the inner surface in the at least one of the plurality of connector portions that individually connect the exhaust ports to the collecting exhaust pipe allows exhaust gases in the at least one of the plurality of connector portions to flow in the downstream direction, thus enabling the exhaust gases from each of the exhaust ports to smoothly flow toward the collecting exhaust pipe in the downstream direction. This makes it possible to achieve a decrease in exhaust pressure loss of the engine.

In a preferred embodiment of the present invention, the engine includes a crankshaft extending along a vertical direction. The vessel propulsion apparatus includes an outboard motor including a drive shaft, a propeller shaft, a propeller, and a transmission. The drive shaft is connected to the crankshaft and extends along the vertical direction. The propeller shaft extends along a horizontal direction. The propeller functions as the propulsion unit, and is connected to the propeller shaft. The transmission is configured to transmit rotation of the drive shaft to the propeller shaft.

With this structural arrangement, in the outboard motor, the rotation of the crankshaft of the engine is transmitted to the propeller shaft through the drive shaft and the transmission, and, as a result, the propeller shaft rotates together with the propeller, and therefore the propeller generates a thrust. In the thus provided outboard motor, it is possible to achieve a decrease in exhaust pressure loss of the engine as described above.

A preferred embodiment of the present invention provides a vessel including a hull and the vessel propulsion apparatus mounted to the hull to provide a thrust to the hull.

With this structural arrangement, in the vessel propulsion apparatus included in the vessel, it is possible to achieve a decrease in exhaust pressure loss of the engine as described above.

A preferred embodiment of the present invention provides a vessel engine including a plurality of cylinders arranged in series and each including a combustion chamber, a plurality of exhaust ports respectively connected to the combustion chambers of the plurality of cylinders and curved in a predetermined downstream direction to allow exhaust gases to flow out from the combustion chambers, and a collecting exhaust pipe. The collecting exhaust pipe is integral with the plurality of exhaust ports and extends in the downstream direction to allow exhaust gases in the plurality of exhaust ports to flow in the downstream direction. At least one of a plurality of connector portions that individually connect the plurality of exhaust ports to the collecting exhaust pipe includes a concave portion at an inner surface thereof.

With this structural arrangement, in the vessel engine, it is possible to achieve a decrease in exhaust pressure loss as described above.

A preferred embodiment of the present invention provides an exhaust structure of a vessel engine including a plurality of cylinders arranged in series and each including a combustion chamber, a plurality of exhaust ports respectively connected to the combustion chambers of the plurality of cylinders and curved in a predetermined downstream direction to allow exhaust gases to flow out from the combustion chambers, and a collecting exhaust pipe. The collecting exhaust pipe is integral with the plurality of exhaust ports and extends in the downstream direction to allow exhaust gases in the exhaust ports to flow in the downstream direction. At least one of a plurality of connector portions that individually connect the plurality of exhaust ports to the collecting exhaust pipe includes a concave portion at an inner surface thereof.

With this structural arrangement, in the vessel engine, it is possible to achieve a decrease in exhaust pressure loss as described above.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
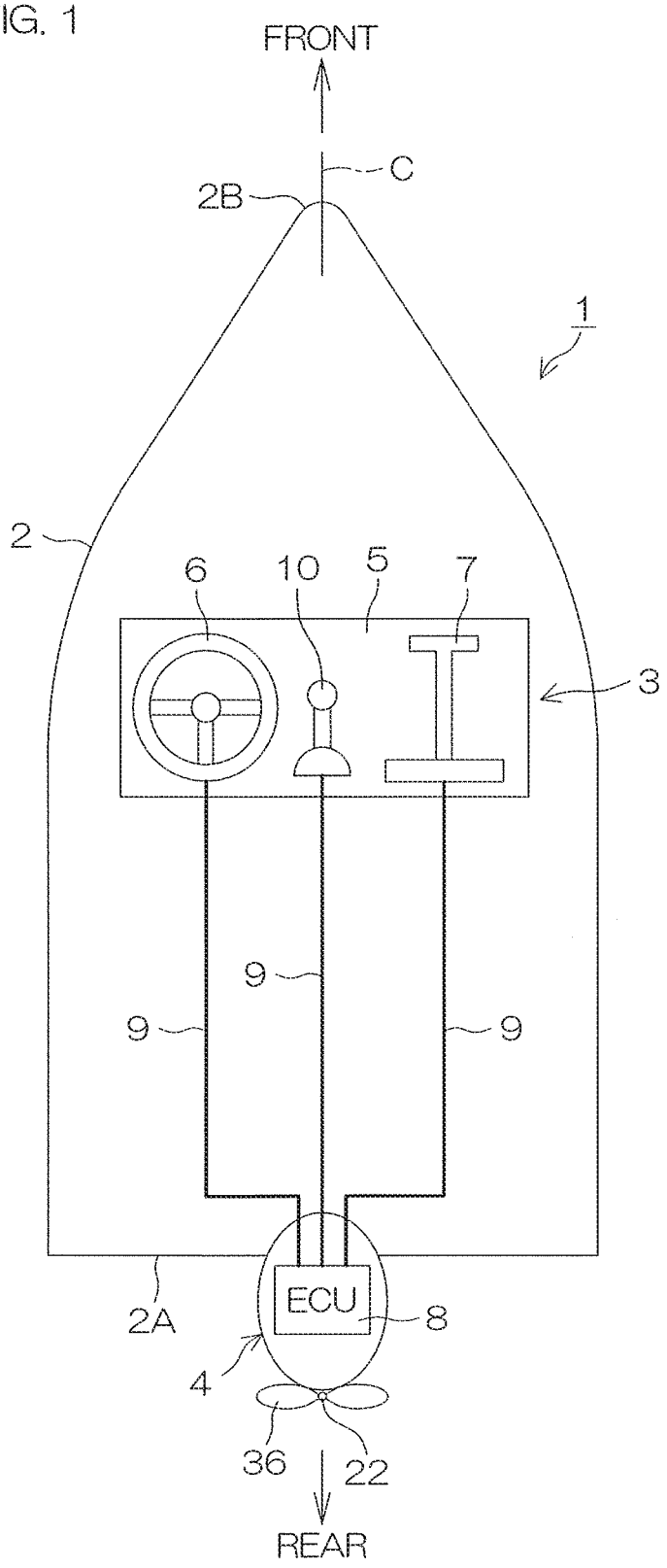
FIG. 1 is a schematic plan view of a vessel according to a preferred embodiment of the present invention.

FIG. 1 is a schematic plan view of a vessel 1 according to a preferred embodiment of the present invention. The vessel 1 includes a hull 2, a vessel operation device 3, and an outboard motor 4, and the hull 2 is equipped with both the vessel operation device 3 and the outboard motor 4. An example of the vessel operation device 3 includes a steering wheel 6 and a throttle lever 7 both of which are provided at an operational platform 5 around a vessel operation seat of the hull 2, and a communication bus 9 by which an ECU (electronic control unit) 8 built into the outboard motor 4, a steering wheel 6, and the throttle lever 7 are connected together. A vessel operator turns the steering wheel 6 in a left-right direction to steer. The vessel operator turns the throttle lever 7 in a front-rear direction to adjust the output of the outboard motor 4. A joystick 10 that is operated by the vessel operator to steer and adjust the output of the outboard motor 4 may be provided at the operational platform 5.

The outboard motor 4 is an example of a vessel propulsion apparatus that provides a thrust to the hull 2, and is provided as a single outboard motor or as a plurality of outboard motors. The single outboard motor 4 is attached to a transom stern 2A on a virtual center line C along the front-rear direction through the transom stern 2A and a bow 2B of the hull 2. The plurality of outboard motors 4 are attached to the transom stern 2A at bilaterally symmetrical positions with respect to the center line C.

Figure 2:
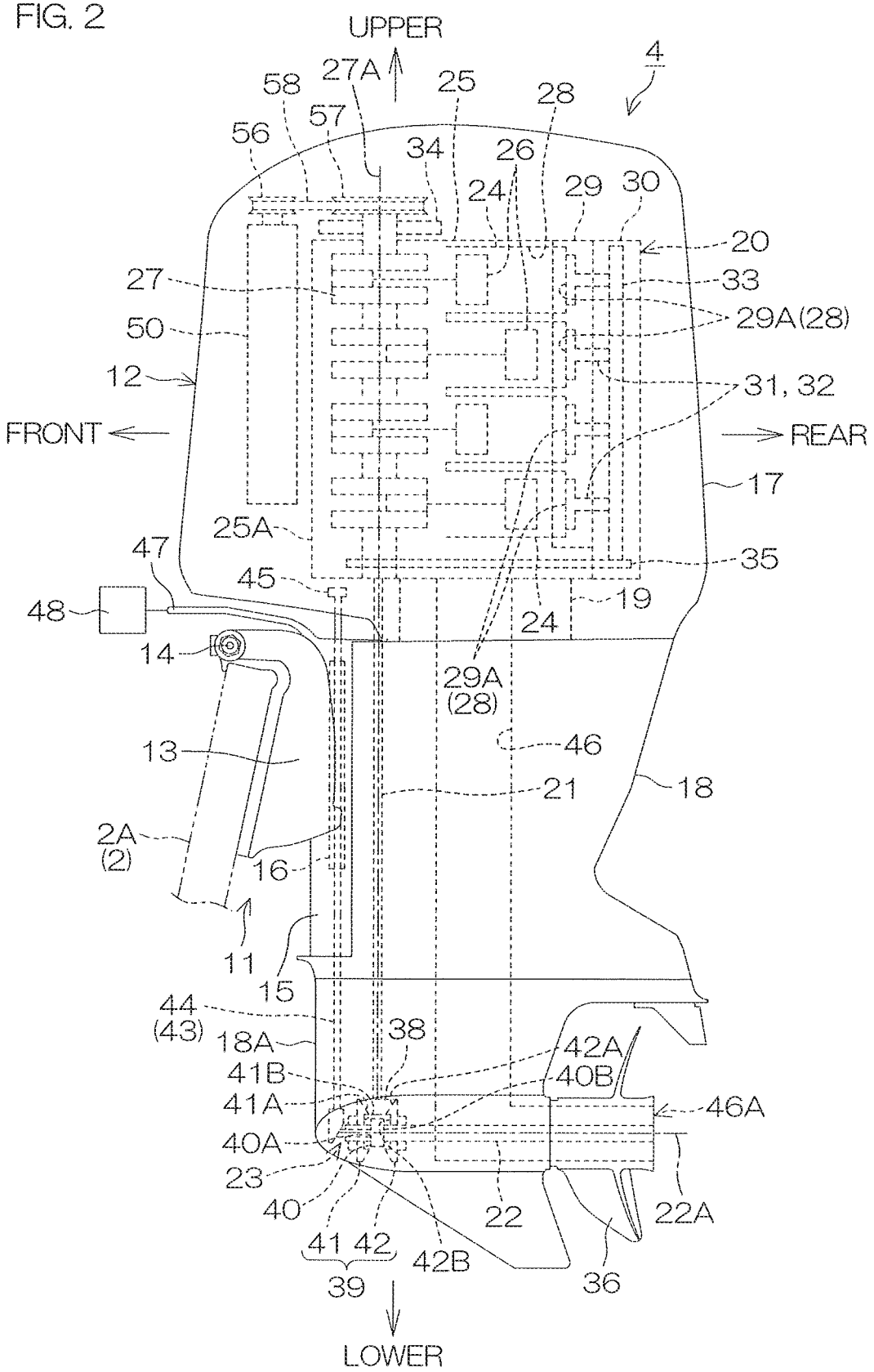
FIG. 2 is a schematic side view of an outboard motor included in the vessel.

FIG. 2 is a schematic right side view of the outboard motor 4. The left side in FIG. 2 is the front side of the outboard motor 4, and the right side in FIG. 2 is the rear side of the outboard motor 4. The upper side in FIG. 2 is the upper side of the outboard motor 4, and the lower side in FIG. 2 is the lower side of the outboard motor 4. An up-down direction is also a vertical direction. A direction perpendicular to the plane of paper of FIG. 2 is the left-right direction of the outboard motor 4. In the following description, a leftward or rightward direction of the outboard motor 4 is determined based on a direction given when the outboard motor 4 is seen from the front side. Therefore, the near side in the direction perpendicular to the plane of paper of FIG. 2 is the right side of the outboard motor 4, and the far side in the direction perpendicular to the plane of paper of FIG. 2 is the left side of the outboard motor 4.

The outboard motor 4 includes a mount 11 to attach the outboard motor 4 to the transom stern 2A and an outboard motor main body 12. The mount 11 includes a clamp bracket 13 fixed to the transom stern 2A and a swivel bracket 15 coupled to the clamp bracket 13 through a tilt shaft 14 horizontally extending in the left-right direction. The swivel bracket 15 is coupled to the outboard motor main body 12 through a steering shaft 16 extending in the up-down direction. Thus, the outboard motor main body 12 is attached to the transom stern 2A by the mount 11 in a vertical or substantial vertical attitude.

The outboard motor main body 12 and the swivel bracket 15 are turnable in the up-down direction around the tilt shaft 14 with respect to the clamp bracket 13. The outboard motor main body 12 is turned around the tilt shaft 14, and, as a result, the outboard motor main body 12 is tilted with respect to the hull 2 and the clamp bracket 13. The outboard motor main body 12 is turnable in the left-right direction together with the steering shaft 16 with respect to the clamp bracket 13 and the swivel bracket 15. When the outboard motor main body 12 turns in the left-right direction, the vessel 1 is steered.

The outboard motor main body 12 includes a box-shaped engine cover 17, a hollow casing 18 extending downwardly from the engine cover 17, and a plate-shaped exhaust guide 19 attached to a lower end portion of the engine cover 17 so as to close an internal space of the casing 18 from above. A lower end portion of the casing 18 is a lower case 18A. The outboard motor main body 12 includes an engine 20 mounted on an upper surface of the exhaust guide 19 in the engine cover 17, a drive shaft 21 extending along the up-down direction in the casing 18, and a propeller shaft 22 and a transmission 23 both of which are located in the lower case 18A.

The engine 20 is a vessel engine, and includes an internal combustion engine that burns fuel, such as gasoline, and generates power. The engine 20 includes a cylinder block 25 including a single or a plurality of cylinders 24, a piston 26 located in the cylinder 24 one by one, and a crankshaft 27 extending along the up-down direction in the cylinder block 25 and that is coupled to the piston(s) 26. The engine 20 in the present preferred embodiment is a straight-type four-cylinder engine in which four cylinders 24 are arranged in series along the up-down direction.

An internal space of each of the cylinders 24 includes a circular cylindrical shape extending along the front-rear direction. A combustion chamber 28 is defined in a region behind the piston 26 in the internal space of each of the cylinders 24. A front portion that houses the crankshaft 27 in the cylinder block 25 is a crank case 25A.

The engine 20 includes a cylinder head 29 attached to the cylinder block 25 from behind and a head cover 30 attached to the cylinder head 29 from behind. The cylinder head 29 and the head cover 30 may be regarded as elements of the cylinder block 25. Concave portions 29A each of which is rearwardly hollowed as a portion of the combustion chamber 28 are provided one by one at a portion, which faces the combustion chamber 28 of each of the cylinders 24, of a front surface of the cylinder head 29. The engine 20 includes an intake valve 31 and an exhaust valve 32 that are exposed to each of the concave portions 29A and a camshaft 33 that extends along the up-down direction and that is rotatably supported by the head cover 30. The camshaft 33 may be provided as a pair of camshafts in accordance with each of the intake valve 31 and the exhaust valve 32.

The crankshaft 27 has a crankshaft axis 27A extending in the up-down direction. An upper end portion of the crankshaft 27 protrudes upwardly from the crank case 25A. A lower end portion of the crankshaft 27 is connected to the upper end portion of the drive shaft 21. The engine 20 includes a flywheel magneto 34 fixed to the upper end portion of the crankshaft 27 and a cam chain 35 connecting the lower end portion of the crankshaft 27 and a lower end portion of the camshaft 33. The flywheel magneto 34 is located at a higher position than the crank case 25A. The cam chain 35 is located below the four cylinders 24 in the cylinder block 25.

The piston 26 is rectilinearly reciprocated in the front-rear direction perpendicular to the crankshaft axis 27A by combustion of an air-fuel mixture in each of the combustion chambers 28. When the piston 26 is rectilinearly reciprocated, the crankshaft 27 is driven and rotated around the crankshaft axis 27A along with the drive shaft 21. In accordance with the rotation of the crankshaft 27, the flywheel magneto 34 rotates and generates electricity, and the cam chain 35 moves in a circular motion. The camshaft 33 is rotated in accordance with the circular movement of the cam chain 35. The intake valve 31 and the exhaust valve 32 are actuated interlockingly with the rotation of the camshaft 33. Thus, intake/exhaust is performed in each of the combustion chambers 28.

The propeller shaft 22 horizontally extends along the front-rear direction in the lower case 18A. A lower end portion of the drive shaft 21 is coupled to a front end portion of the propeller shaft 22 by the transmission 23. A rear end portion of the propeller shaft 22 protrudes rearwardly from the lower case 18A. A propeller 36 as an example of a propulsion unit that is an element of the outboard motor 4 is connected to the rear end portion of the propeller shaft 22. The propeller shaft 22 rotates together with the propeller 36 around a rotational axis 22A that extends in the front-rear direction.

The transmission 23 is used to transmit the rotation of the drive shaft 21 to the propeller shaft 22. The transmission 23 includes a driving gear 38 fixed to the lower end portion of the drive shaft 21 and a rotary body 39 and a dog clutch 40 both of which are attached to the front end portion of the propeller shaft 22. The driving gear 38 is a bevel gear. The propeller shaft 22 is located below the driving gear 38. The rotary body 39 includes a first rotary body 41 and a second rotary body 42 that are located side by side in the front-rear direction along the propeller shaft 22. The first rotary body 41 and the second rotary body 42 are, for example, cylindrical bevel gears, respectively.

In the present preferred embodiment, the first rotary body 41 is located at a more forward position than the driving gear 38, and the second rotary body 42 is located at a more rearward position than the driving gear 38, and yet the front-rear positional relationship between the first rotary body 41 and the second rotary body 42 may be opposite to that of the present preferred embodiment. In a rear surface of the first rotary body 41, a tooth portion 41A is provided at a tapered outer peripheral portion, and a claw portion 41B is provided at an inner peripheral portion. In a front surface of the second rotary body 42, a tooth portion 42A is provided at a tapered outer peripheral portion, and a claw portion 42B is provided at an inner peripheral portion.

The first rotary body 41 surrounds a portion, which is at a more forward position than the driving gear 38, of the front end portion of the propeller shaft 22, and the second rotary body 42 surrounds a portion, which is at a more rearward position than the driving gear 38, of the front end portion of the propeller shaft 22. The first rotary body 41 and the second rotary body 42 are located so that their tooth portions 41A and 42A face each other at a distance from each other in the front-rear direction, and engage with the driving gear 38. When the driving gear 38 rotates together with the drive shaft 21 in response to the driving of the engine 20, the rotation of the driving gear 38 is transmitted to the first rotary body 41 and to the second rotary body 42. Thus, the first rotary body 41 and the second rotary body 42 rotate around the rotational axis 22A of the propeller shaft 22 in mutually opposite directions.

The dog clutch 40 is located between the first rotary body 41 and the second rotary body 42. The dog clutch 40 is, for example, cylindrical, and surrounds the front end portion of the propeller shaft 22. A first claw portion 40A is provided at a front end surface of the dog clutch 40, and a second claw portion 40B is provided at a rear end surface of the dog clutch 40. The dog clutch 40 is coupled to the front end portion of the propeller shaft 22 by, for example, a spline. Therefore, the dog clutch 40 rotates together with the front end portion of the propeller shaft 22. Additionally, the dog clutch 40 is movable in the front-rear direction with respect to the front end portion of the propeller shaft 22. In other words, the dog clutch 40 is rotatable together with the propeller shaft 22, and is movable along the front-rear direction relatively with the propeller shaft 22.

The transmission 23 also includes a shifter 43 located at a more forward position than the propeller shaft 22 in the lower case 18A. The shifter 43 includes, for example, a shift rod 44 extending in the up-down direction and an electric shift actuator 45 connected to the shift rod 44. A lower end portion of the shift rod 44 is coupled to the dog clutch 40. When the shift actuator 45 is operated by the control of the ECU 8 (see FIG. 1), the shift rod 44 turns around an axis of the shift rod 44. The shift rod 44 turns, and, as a result, the dog clutch 40 is moved along the front-rear direction between a disconnection position and a connection position.

The disconnection position is a position in which the dog clutch 40 is spaced apart from the first rotary body 41 and the second rotary body 42, and does not engage with either of these rotary bodies of the rotary body 39 as shown in FIG. 2. In a state in which the dog clutch 40 is located in the disconnection position, each of the rotary body 39 to which the rotation of the drive shaft 21 is transmitted runs idle, and therefore the rotation of the drive shaft 21 is not transmitted to the propeller shaft 22. In the following description, the shift position of the outboard motor 4 at this time is referred to as "neutral."

The connection position is a position in which the dog clutch 40 engages with either one of the first rotary body 41 or the second rotary body 42. The connection position includes a first connection position in which the first claw portion 40A of the dog clutch 40 engages with only the claw portion 41B of the first rotary body 41 and a second connection position in which the second claw portion 40B of the dog clutch 40 engages with only the claw portion 42B of the second rotary body 42. The disconnection position is a position between the first connection position and the second connection position. The first connection position is more forward than the disconnection position, and the second connection position is more rearward than the disconnection position.

In a state in which the dog clutch 40 is located in the first connection position and is coupled to only the first rotary body 41, the rotation of the first rotary body 41 is transmitted to the propeller shaft 22, and therefore the shift position of the outboard motor 4 is shifted into "forward." Thereupon, the rotation of the drive shaft 21 is transmitted to the propeller shaft 22 through the first rotary body 41 and the dog clutch 40, and, as a result, the propeller 36 rotates in a forward rotational direction (for example, a clockwise direction when seen from the rear side). Thus, the propeller 36 is driven by the engine 20, and a forward thrust is generated.

In a state in which the dog clutch 40 is located in the second connection position and is coupled to only the second rotary body 42, the rotation of the second rotary body 42 is transmitted to the propeller shaft 22, and therefore the shift position of the outboard motor 4 is shifted into "reverse." Thereupon, the rotation of the drive shaft 21 is transmitted to the propeller shaft 22 through the second rotary body 42 and the dog clutch 40, and, as a result, the propeller 36 rotates in a reverse rotational direction opposite to the forward rotational direction. Thus, the propeller 36 is driven by the engine 20, and a reverse thrust is generated. As thus described, in the present preferred embodiment, the first rotary body 41 is a gear for forward movement, and the second rotary body 42 is a gear for reverse movement. Of course, the first rotary body 41 may be a gear for reverse movement, and the second rotary body 42 may be a gear for forward movement.

The outboard motor main body 12 includes an exhaust passage 46 provided inside the outboard motor main body 12 and connected to the engine 20. The exhaust passage 46 passes through the exhaust guide 19 in the up-down direction, and extends downwardly in the casing 18 and rearwardly in the propeller 36. The exhaust passage 46 includes an outlet 46A provided at a rear end surface of the propeller 36. In a state in which the vessel 1 is floating on water and in which the propeller 36 is located below a water surface, the outlet 46A is located in the water, and therefore water that has passed through the outlet 46A enters a downstream portion of the exhaust passage 46. On the other hand, when the engine 20 rotates at a high speed, water in the exhaust passage 46 is pushed by the pressure of an exhaust gas emitted from the engine 20, and is discharged from the outlet 46A together with the exhaust gas. Thus, the exhaust gas generated by the engine 20 is discharged into the water.

A steering rod 47 that forwardly extends is fixed to the outboard motor main body 12. An electric steering actuator 48 that is controlled by the ECU 8 is connected to the steering rod 47. The outboard motor main body 12 is able to turn around the steering shaft 16 by allowing the steering actuator 48 to operate, thus making it possible to perform steering.

Figure 3:
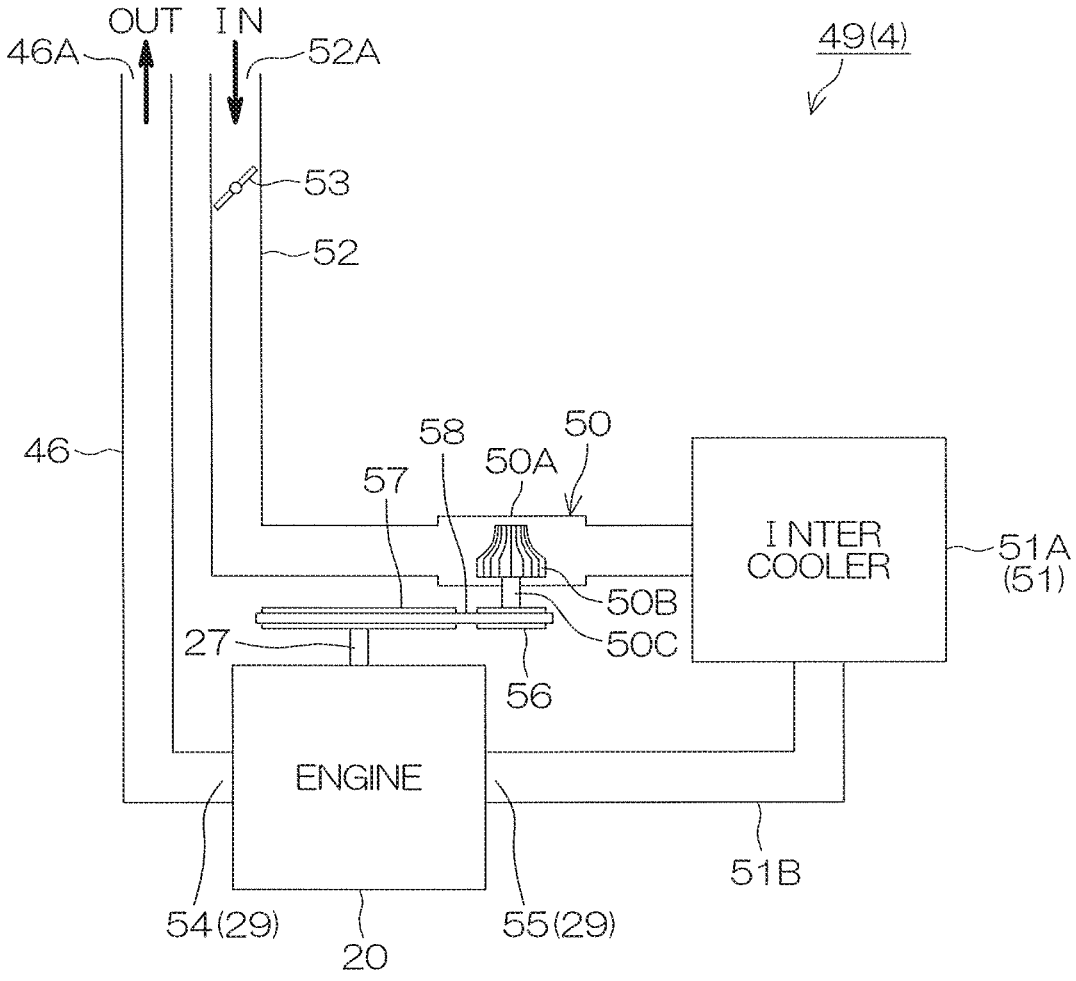
FIG. 3 is a schematic view shown to describe an air intake/exhaust system of the outboard motor.

FIG. 3 is a schematic view shown to describe an air intake/exhaust system 49 of the outboard motor 4. The air intake/exhaust system 49 includes the engine 20, a pressure charger 50 that compresses air and supplies the air to the engine 20, and an intercooler 51 that cools air compressed by the pressure charger 50.

With respect to the air intake/exhaust system 49, the engine 20 includes the exhaust passage 46, an air intake passage 52, and an electric throttle valve 53 located in the air intake passage 52. The exhaust passage 46 is connected to each of the combustion chambers 28 through a plurality of exhaust ports 54 provided in the cylinder head 29 of the engine 20. The air intake passage 52 is connected to each of the combustion chambers 28 through a plurality of intake ports 55 provided in the cylinder head 29. An inlet 52A is provided at an end portion, which is opposite to the intake port 55, of the air intake passage 52. The ECU 8 controls the throttle valve 53, and, as a result, the opening degree of the throttle valve 53 is adjusted.

The pressure charger 50 is interposed between the ends of the air intake passage 52. The pressure charger 50 is a supercharger driven by the rotation of the crankshaft 27 of the engine 20. The pressure charger 50 includes a housing 50A including an internal space defining a portion of the air intake passage 52, a compressor wheel 50B located in the housing 50A, and a rotational shaft 50C coaxially fixed to the compressor wheel 50B. An end portion, which is spaced apart from the compressor wheel 50B, of the rotational shaft 50C is located outside the housing 50A, and a rotor 56 is coaxially fixed to this end portion.

The air intake/exhaust system 49 includes a power transmission by which the crankshaft 27 and the pressure charger 50 are connected together. An example of the power transmission includes the rotor 56, another rotor 57 attached to the crankshaft 27, and a belt 58 by which the rotor 56 and the rotor 57 are connected together. An example of each of the rotors 56 and 57 is a pulley. The rotor 57 is attached to a portion, which is located at a higher position than the flywheel magneto 34, of the upper end portion of the crankshaft 27 (see FIG. 2).

When the crankshaft 27 rotates, the rotor 57 rotates together with the crankshaft 27. The rotation of the rotor 57 is transmitted to the rotor 56 through the belt 58. Thereupon, the rotational shaft 50C rotates together with the compressor wheel 50B, and, as a result, the pressure charger 50 is driven. A sprocket may be used as each of the rotors 56 and 57 instead of the pulley, and a chain may be used instead of the belt 58.

When the pressure charger 50 operates in a state in which the throttle valve 53 has been opened, air that has been taken from the inlet 52A and that flows through the air intake passage 52 is compressed by the compressor wheel 50B rotating in the housing 50A. Another arrangement, such as a Lysholm-type device, may be used as the pressure charger 50 without being limited to the centrifugal-type device shown in FIG. 3.

The intercooler 51 is interposed between each of the intake ports 55 of the engine 20 and the pressure charger 50 in the air intake passage 52. The intercooler 51 includes a housing 51A including an internal space defining a portion of the air intake passage 52 and a cooling fin (not shown). Either of an air-cooled intercooler or a water-cooled intercooler may be used as the intercooler 51. The intercooler 51 includes an intake manifold 51B that extends from the housing 51A and is connected to the intake port 55. The intake manifold 51B is integral with the housing 51A.

Air compressed by the compressor wheel 50B in the housing 50A of the pressure charger 50 continuously flows through the air intake passage 52, and thus is guided to the intercooler 51, and is cooled by heat exchange with the cooling fin in the housing 51A of the intercooler 51. The air cooled by the intercooler 51 flows through the intake manifold 51B, and then is turned into an air-fuel mixture, supplied from the intake port 55 to the combustion chamber 28 in the cylinder 24, and combusted. Exhaust gas generated by the combustion flows from the exhaust port 54 through the exhaust passage 46, and then is discharged from the outlet 46A into the water as described above.

Figure 4:
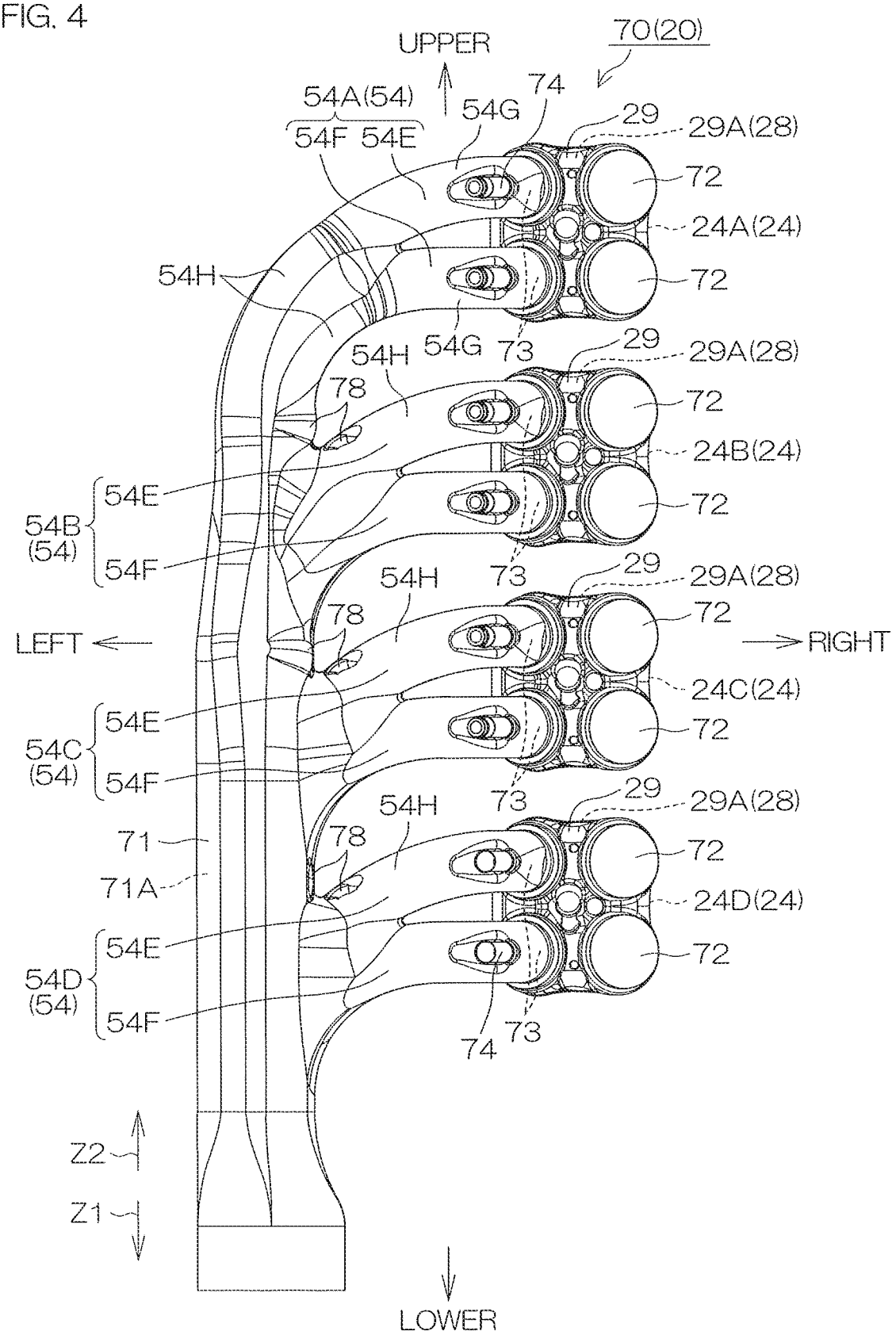
FIG. 4 is a rear view of a main portion of an exhaust structure in the air intake/exhaust system.

FIG. 4 is a rear view of a main portion of an exhaust structure 70 included in the air intake/exhaust system 49 of the engine 20. The exhaust structure 70 includes the plurality of exhaust ports 54 and a collecting exhaust pipe 71 located on the left side of the exhaust ports 54. The cylinder head 29 may be provided as a single cylinder head so as to straddle between the plurality of (in the present preferred embodiment, four) cylinders 24 arranged side by side in the up-down direction, and the concave portions 29A (a portion of the combustion chamber 28) whose number is equal to that of the cylinders 24 may be provided at the cylinder head 29. Alternatively, the cylinder head 29 may be provided as a plurality of cylinder heads so as to respectively correspond to the cylinders 24 on a one-to-one basis as shown in FIG. 4. In this case, the plurality of cylinder heads 29 are arranged side by side in the up-down direction, and the concave portions 29A are respectively provided at the cylinder heads 29 one by one.

In the following description, the uppermost cylinder 24 among the four cylinders 24 in the up-down direction will be referred to as a first cylinder 24A if necessary, and the cylinder 24 downwardly of and next to the first cylinder 24A will be referred to as a second cylinder 24B if necessary. The cylinder 24 downwardly of and next to the second cylinder 24B will be referred to as a third cylinder 24C if necessary, and the cylinder 24 downwardly of and next to the third cylinder 24C, i.e., the lowermost cylinder 24 will be referred to as a fourth cylinder 24D if necessary. In the present preferred embodiment, a downward direction Z1 is an example of a predetermined downstream direction, and the first cylinder 24A is located at the head or top in a direction opposite to the downstream direction (i.e., upward direction Z2).

A pair of intake openings 72 and a pair of exhaust openings 73 are provided in a region of a rear surface of the cylinder head 29 that coincides with the combustion chamber 28 in a rear view. The intake opening 72 and the exhaust opening 73 are each a round hole that extends through the cylinder head 29 in the front-rear direction or substantially in the front-rear direction. A single intake valve 31 is located at a single intake opening 72, and a single exhaust valve 32 is located at a single exhaust opening 73 (not shown).

For the intake opening 72 and the exhaust opening 73 that correspond to a single combustion chamber 28, the pair of exhaust openings 73 arranged side by side along the up-down direction are located at a more leftward location than the pair of intake openings 72 arranged side by side along the up-down direction. The pair of intake openings 72 and the pair of exhaust openings 73 communicate with the combustion chamber 28 from the rear. The intake port 55 is provided as a plurality of (in the present preferred embodiment, eight) intake ports whose number is equal to that of the intake openings 72, and the intake ports 55 are each a circular tubular pipe passage, and the single intake port 55 is connected to the single intake opening 72 (not shown).

The exhaust port 54 is a circular tubular pipe passage, and is provided as a pair of exhaust ports for each cylinder 24, i.e., for each combustion chamber 28, and eight exhaust ports 54 in total are provided in the present preferred embodiment. Each of the exhaust ports 54 is connected to a single exhaust opening 73. Thus, the plurality of exhaust ports 54 are connected to the plurality of combustion chambers 28, respectively.

In the following description, the pair of exhaust ports 54 connected to the combustion chamber 28 of the first cylinder 24A will be referred to as a pair of first exhaust ports 54A if necessary, and the pair of exhaust ports 54 connected to the combustion chamber 28 of the second cylinder 24B will be referred to as a pair of second exhaust ports 54B if necessary. The pair of exhaust ports 54 connected to the combustion chamber 28 of the third cylinder 24C will be referred to as a pair of third exhaust ports 54C if necessary, and the pair of exhaust ports 54 connected to the combustion chamber 28 of the fourth cylinder 24D will be referred to as a pair of fourth exhaust ports 54D if necessary. The pair of second exhaust ports 54B are located downwardly of and next to the pair of first exhaust ports 54A, and the pair of third exhaust ports 54C are located downwardly of and next to the pair of second exhaust ports 54B, and the pair of fourth exhaust ports 54D are located downwardly of and next to the pair of third exhaust ports 54C.

The pair of exhaust ports 54 connected to each of the combustion chambers 28 include an upstream exhaust port 54E and a downstream exhaust port 54F located at a more downward location in the downward direction Z1 than the upstream exhaust port 54E. Referring to the pair of first exhaust ports 54A, each of the upstream exhaust port 54E and the downstream exhaust port 54F includes an upstream portion 54G connected to the combustion chamber 28 and a downstream portion 54H connected to the collecting exhaust pipe 71 while being curved in the downward direction Z1 from the upstream portion 54G.

The upstream portion 54G is provided with a valve guide 74 that supports the exhaust valve 32 (see FIG. 2). In FIG. 4 and the figures subsequent to FIG. 4, the intake valve 31 and the exhaust valve 32 are omitted and are not shown. The downstream portion 54H of the upstream exhaust port 54E and the downstream portion 54H of the downstream exhaust port 54F are merged together.

The collecting exhaust pipe 71 extends in the downward direction Z1 as an upstream portion of the exhaust passage 46. The inner surface 71A of the collecting exhaust pipe 71 has a cylindrical shape (for example, a circular cylindrical shape or a substantially circular cylindrical shape) extending in the up-down direction. The collecting exhaust pipe 71 is integral with each of the exhaust ports 54. This makes it possible to make the engine 20 compact (particularly in the left-right direction in the present preferred embodiment). The downstream portions 54H of the pair of first exhaust ports 54A are connected to an upper end of the collecting exhaust pipe 71 from the upward direction Z2. The downstream portions 54H of the pair of second exhaust ports 54B are connected to the collecting exhaust pipe 71 from the right side. The downstream portions 54H of the pair of third exhaust ports 54C are connected to the collecting exhaust pipe 71 from the right side. The downstream portions 54H of the pair of fourth exhaust ports 54D are connected to the collecting exhaust pipe 71 from the right side. The downstream portion 54H of each of the exhaust ports 54 and a portion of the collecting exhaust pipe 71 that is adjacent to the downstream portion 54H define a connector portion between the exhaust port 54 and the collecting exhaust pipe 71.

Figure 5:
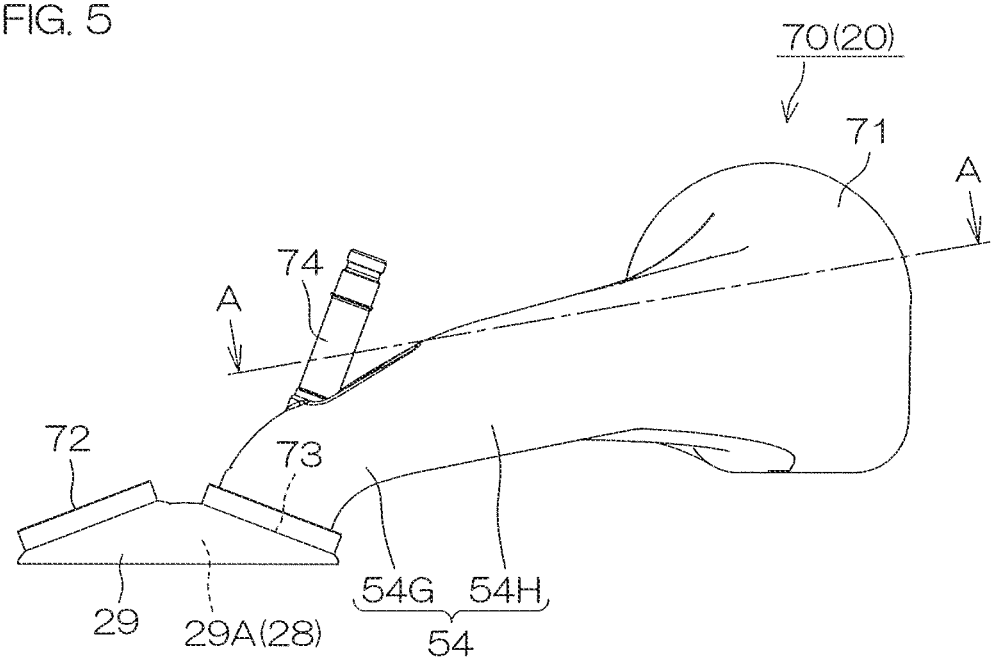
FIG. 5 is a plan view of a main portion of the exhaust structure.
Figure 6:
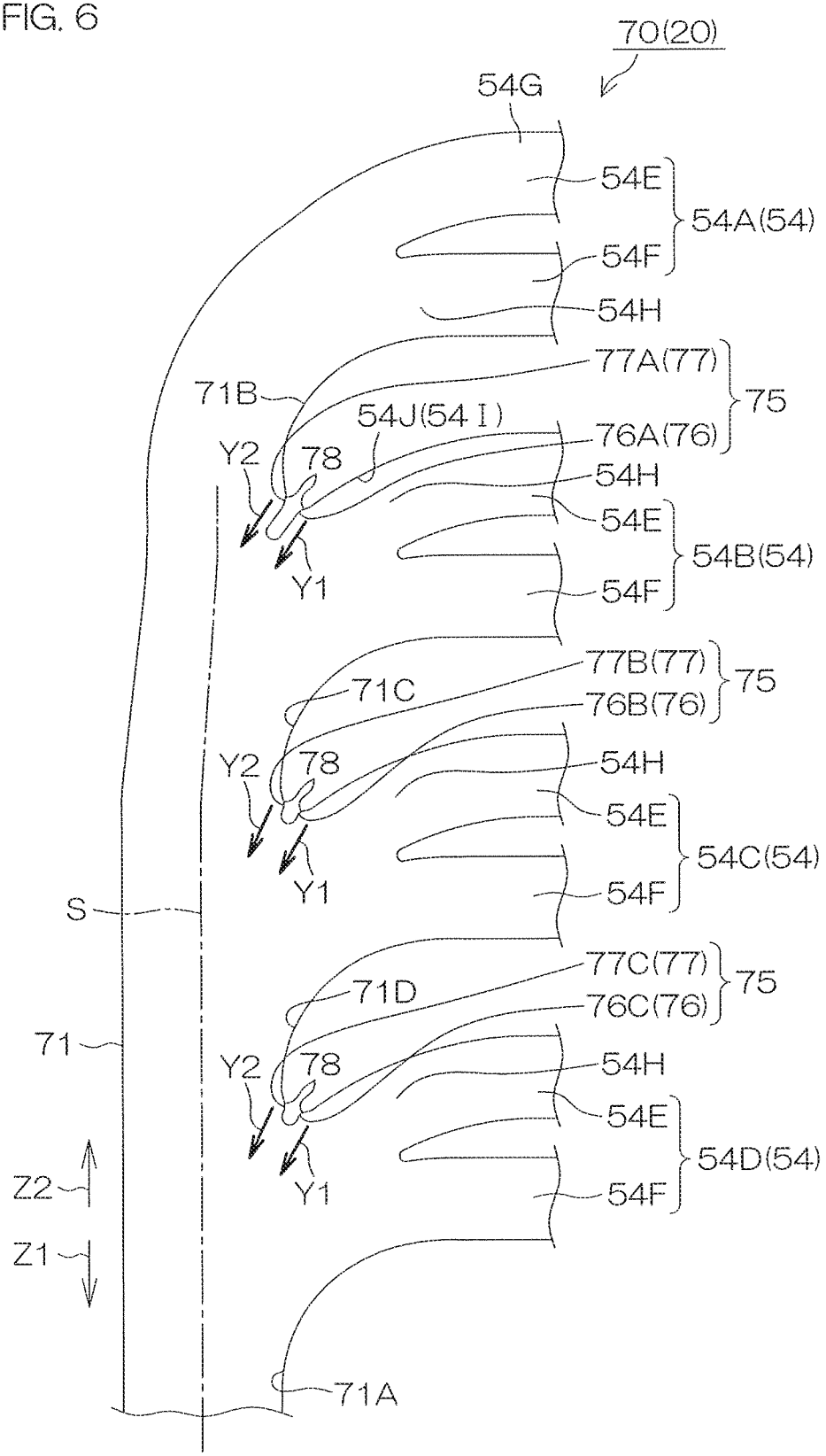
FIG. 6 is a cross-sectional view taken along line A-A in FIG. 5.

FIG. 5 is a plan view of a main portion of the exhaust structure 70. FIG. 6 is a cross-sectional view taken along line A-A in FIG. 5. A plurality of concave portions 75 are provided at an inner surface in the connector portion between the exhaust port 54 and the collecting exhaust pipe 71. More specifically, the plurality of concave portions 75 include a first concave portion 76 provided at an inner surface 54I of the downstream portion 54H that is a root of the exhaust port 54 and a second concave portion 77 provided in a region of the inner surface 71A of the collecting exhaust pipe 71 that is adjacent to the downstream portion 54H in the downward direction Z1. Each of the first and second concave portions 76 and 77 may be a hemispherically hollowed concave portion, or may be a groove extending along a circumferential direction of the exhaust port 54 or along a circumferential direction of the collecting exhaust pipe 71. The first concave portion 76 and the second concave portion 77 are each provided as three concave portions in the present preferred embodiment.

The three first concave portions 76 include a first concave portion 76A provided at the second exhaust port 54B, a first concave portion 76B provided at the third exhaust port 54C, and a first concave portion 76C provided at the fourth exhaust port 54D. The first concave portion 76 is not provided at the first exhaust port 54A.

Figure 7:
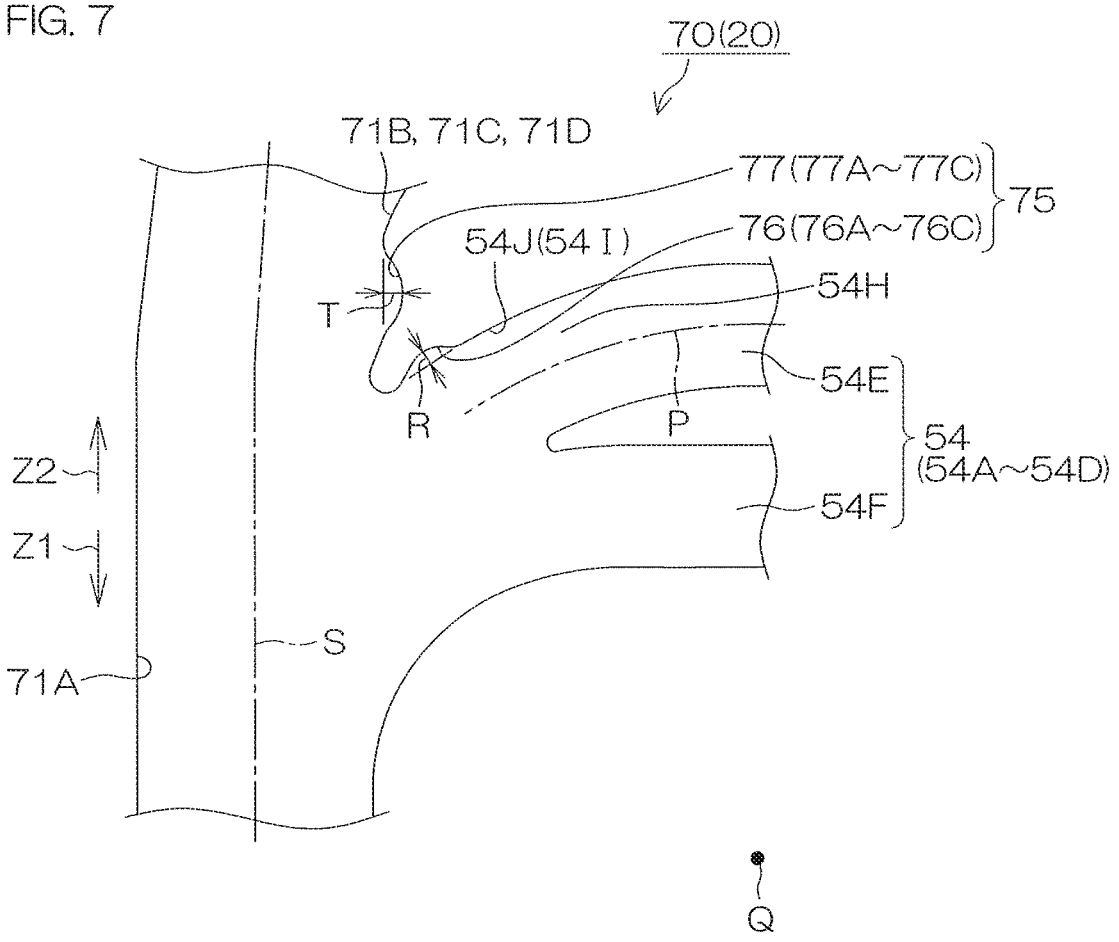
FIG. 7 is an enlarged view of a portion of FIG. 6.

Each of the first concave portions 76A, 76B, and 76C is provided in a region 54J, which is more distant from a center of curvature Q of the downstream portion 54H than a central axis P of the downstream portion 54H, of the inner surface 54I of the downstream portion 54H of the corresponding upstream exhaust port 54E (see FIG. 7). The central axis P is a virtual line extending through the center of the inner surface 54I of the downstream portion 54H (i.e., the center of a flow-passage cross section of the downstream portion 54H). The center of curvature Q of the downstream portion 54H may be a center of curvature of the central axis P of the downstream portion 54H. Regarding at least either one among a depth dimension R, an opening area, and a volume of the first concave portion 76 (see FIG. 7), the first concave portion 76A may be larger than the first concave portions 76B and 76C provided at the other exhaust ports 54. The depth dimension R is about several millimeters, for example.

The second concave portion 77 includes a second concave portion 77A adjacent to the pair of first exhaust ports 54A, a second concave portion 77B adjacent to the pair of second exhaust ports 54B, and a second concave portion 77C adjacent to the pair of third exhaust ports 54C. The second concave portion 77 is not provided in a region located at a more downward location in the downward direction Z1 than the pair of fourth exhaust ports 54D.

The second concave portion 77A is provided in a region 71B of the inner surface 71A of the collecting exhaust pipe 71 that is adjacent to the downstream portion 54H of the downstream exhaust port 54F of the pair of first exhaust ports 54A in the downward direction Z1. The second concave portion 77B is provided in a region 71C of the inner surface 71A that is adjacent to the downstream portion 54H of the downstream exhaust port 54F of the pair of second exhaust ports 54B in the downward direction Z1. The second concave portion 77C is provided in a region 71D of the inner surface 71A that is adjacent to the downstream portion 54H of the downstream exhaust port 54F of the pair of third exhaust ports 54C in the downward direction Z1.

The regions 71B, 71C, and 71D are regions of the inner surface 71A of the collecting exhaust pipe 71 that are closer to each of the exhaust ports 54 than a central axis S of the collecting exhaust pipe 71. The central axis S is a virtual line extending through the center of the inner surface 71A of the collecting exhaust pipe 71 (i.e., the center of a flow-passage cross section of the collecting exhaust pipe 71). Regarding at least either one among a depth dimension T, an opening area, and a volume of the second concave portion 77 (see FIG. 7), the second concave portion 77A may be larger than the second concave portions 77B and 77C provided in the other regions 71C and 71D. The depth dimension T is about several millimeters, for example.

A convex portion 78 that protrudes between each of the concave portions 75 is provided at each outer surface of the exhaust port 54 and of the collecting exhaust pipe 71.

The pair of first exhaust ports 54A allow exhaust gases to flow out from the combustion chamber 28 of the first cylinder 24A. The pair of second exhaust ports 54B allow exhaust gases to flow out from the combustion chamber 28 of the second cylinder 24B. The pair of third exhaust ports 54C allow exhaust gases to flow out from the combustion chamber 28 of the third cylinder 24C. The pair of fourth exhaust ports 54D allow exhaust gases to flow out from the combustion chamber 28 of the fourth cylinder 24D. The exhaust ports 54 allow exhaust gases discharged from the corresponding combustion chambers 28 to flow in the same direction, i.e., in a downstream direction (in the present preferred embodiment, in the downward direction Z1), and the collecting exhaust pipe 71 allows exhaust gases in each of the exhaust ports 54 to continuously flow in the downward direction Z1. The collecting exhaust pipe 71 receives exhaust gases from each of the exhaust ports 54, and allows the exhaust gases to flow in the downward direction Z1.

The concave portion 75 provided at a connector portion between each of the exhaust ports 54 and the collecting exhaust pipe 71 functions as a guide that allows exhaust gases at this connector portion to flow in the downward direction Z1. More specifically, each of the first concave portions 76 allows exhaust gases at a merging portion of the downstream portion 54H of the upstream exhaust port 54E and the downstream portion 54H of the downstream exhaust port 54F to effectively flow in the downward direction Z1 (see the thick solid arrow Y1 in FIG. 6). Therefore, it is possible to allow exhaust gases from each of the exhaust ports 54 to smoothly flow toward the collecting exhaust pipe 71 in the downward direction Z1. This makes it possible to achieve a decrease in exhaust pressure loss of the engine 20 and to achieve a decrease in pumping loss resulting from this decrease.

Particularly in a case in which the first concave portion 76A is larger than the other first concave portions 76, the first concave portion 76A allows exhaust gases in the downstream portion 54H of the second exhaust port 54B to effectively flow in the downward direction Z1 so as not to flow toward the first exhaust port 54A side, i.e., so as not to flow in the upward direction Z2. Therefore, it is possible to allow exhaust gases from the second exhaust port 54B connected to the combustion chamber 28 of the second cylinder 24B to flow toward the collecting exhaust pipe 71 in the downward direction Z1 more smoothly.

Each of the second concave portions 77 allows exhaust gases in the collecting exhaust pipe 71 to flow in the downward direction Z1 (see the thick solid arrow Y2 in FIG. 6). More specifically, the second concave portion 77A provided in the region 71B, which is adjacent to the first exhaust port 54A in the downward direction Z1, separates exhaust gases flowing along the region 71B from the region 71B so as not to flow toward the second to fourth exhaust ports 54B to 54D located farther downward in the downward direction Z1, and allows the exhaust gases to flow in the downward direction Z1. The second concave portion 77B provided in the region 71C, which is adjacent to the second exhaust port 54B in the downward direction Z1, separates exhaust gases flowing along the region 71C from the region 71C so as not to flow toward the third and fourth exhaust ports 54C and 54D located farther downward in the downward direction Z1 than the region 71C, and allows the exhaust gases to flow in the downward direction Z1. The second concave portion 77C provided in the region 71D, which is adjacent to the downstream portion 54H of the third exhaust port 54C in the downward direction Z1, separates exhaust gases flowing along the region 71D from the region 71D so as not to flow toward the fourth exhaust port 54D located farther downward in the downward direction Z1 than the region 71D, and allows the exhaust gases to flow in the downward direction Z1.

Therefore, exhaust gases that have flowed into the collecting exhaust pipe 71 from each of the exhaust ports 54 are allowed to continuously flow into the collecting exhaust pipe 71, thus enabling the exhaust gases to smoothly flow in the downward direction Z1. Particularly in a case in which the second concave portion 77A is larger than the other second concave portions 77B and 77C, the second concave portion 77A allows exhaust gases in the region 71B to effectively flow in the downstream direction so as not to backwardly flow toward the first exhaust port 54A. Therefore, exhaust gases that have flowed into the collecting exhaust pipe 71 from the first exhaust port 54A are allowed to continuously flow into the collecting exhaust pipe 71, thus enabling the exhaust gases to smoothly flow in the downstream direction.

The pressure charger 50 includes only the supercharger in the above-described preferred embodiments. The outboard motor 4 may be provided with a turbocharger (not shown) driven by exhaust gases passing through the exhaust passage 46. The pressure charger 50 may include only a turbocharger, or may include both a supercharger and a turbocharger.

Additionally, an inboard/outboard motor, or an inboard motor, or a waterjet drive may be used as an example of a vessel propulsion apparatus other than the outboard motor 4. In the inboard/outboard motor, a vessel engine arranged in the same way as the engine 20 is located inside the vessel, and a drive unit including a propulsion unit (propeller 36, etc.) and a steering assembly is located outside the vessel. The inboard motor is a vessel engine and a drive unit that are built into the hull 2 and in which the propeller 36 is attached to a propeller shaft extending from the drive unit and outwardly from the vessel. In this case, the steering assembly is separately provided. The waterjet drive is arranged to accelerate water taken in from a vessel bottom by a pump, and jet the water from a jet nozzle of a transom stern, and thus obtain a thrust. In this case, the pump is driven by the vessel engine, and the steering assembly includes the jet nozzle and a mechanism that turns the jet nozzle along a horizontal plane. In the vessel engine, a plurality of cylinders 24 may be arranged in series along the horizontal direction, etc., so that the crankshaft 27 extends in the front-rear direction.

Various features described above may be appropriately combined together. Additionally, an arrangement may be used in which only either one of the first concave portion 76 and the second concave portion 77 described above is provided. At least one of the connector portions that individually connect the exhaust ports 54 to the collecting exhaust pipe 71 may include the concave portion 75 which includes at least one of the first concave portion 76 and the second concave portion 77.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion apparatus comprising:

an engine; and a propulsion unit to be driven by the engine; wherein the engine includes:

a plurality of cylinders arranged in series and each including a combustion chamber;

a plurality of exhaust ports respectively connected to the combustion chambers of the plurality of cylinders and curved in a predetermined downstream direction of a flow of exhaust gases to allow the exhaust gases to flow out from the combustion chambers;

a collecting exhaust pipe integral with the plurality of exhaust ports and extending in the downstream direction to allow the exhaust gases in the plurality of exhaust ports to flow in the downstream direction; and a plurality of connector portions that individually connect the plurality of exhaust ports to the collecting exhaust pipe, and each of the plurality of connector portions includes a first concave portion at an inner surface thereof and a second concave portion located in a region of an inner surface of the collecting exhaust pipe, and the first concave portion and the second concave portion do not extend through the plurality of connector portions.

2. The vessel propulsion apparatus according to claim 1, wherein each of the plurality of exhaust ports includes an upstream portion connected to the combustion chamber and a downstream portion that is curved from the upstream portion in the downstream direction and connected to the collecting exhaust pipe; and the first concave portion is located at an inner surface of the downstream portion.

3. The vessel propulsion apparatus according to claim 2, wherein the first concave portion is located in a region of the inner surface of the downstream portion that is more distant from a center of curvature of the downstream portion than a central axis of the downstream portion.

4. The vessel propulsion apparatus according to claim 3, wherein the exhaust port includes a pair of exhaust ports for each of the plurality of cylinders;

the pair of exhaust ports include an upstream exhaust port and a downstream exhaust port located farther downward in the downstream direction of the flow of exhaust gases than the upstream exhaust port;

the downstream portion of the upstream exhaust port and the downstream portion of the downstream exhaust port are merged together; and the first concave portion is located in a region of an the inner surface of the downstream portion of the upstream exhaust port that is more distant from a center of curvature of the downstream portion of the upstream exhaust port than a central axis of the downstream portion of the upstream exhaust port.

5. The vessel propulsion apparatus according to claim 4, wherein, in a cross section of the downstream portion containing the center of the curvature of the downstream portion and the central axis of the downstream portion, the first concave portion has a radius of curvature that is smaller than a radius of curvature of the region of the inner surface of the downstream portion.

6. The vessel propulsion apparatus according to claim 2, wherein the plurality of cylinders include a first cylinder located at a top of the plurality of cylinders in a direction opposite to the downstream direction and a second cylinder adjacent to the first cylinder; and the first concave portion located at the exhaust port connected to the combustion chamber of the second cylinder is larger than the first concave portion located at the exhaust port connected to the combustion chamber of any cylinder other than the second cylinder of the plurality of cylinders.

7. The vessel propulsion apparatus according to claim 1, wherein each of the plurality of exhaust ports includes an upstream portion connected to the combustion chamber and a downstream portion that is curved from the upstream portion in the downstream direction and connected to the collecting exhaust pipe; and the second concave portion is located in a region of the inner surface of the collecting exhaust pipe that is adjacent to the downstream portion.

8. The vessel propulsion apparatus according to claim 7, wherein the second concave portion is located in a region of the inner surface of the collecting exhaust pipe that is closer to the exhaust port than a central axis of the collecting exhaust pipe.

9. The vessel propulsion apparatus according to claim 7, wherein the plurality of cylinders include a first cylinder located at a top of the plurality of cylinders in a direction opposite to the downstream direction and other cylinders; and the second concave portion, located in a region of the inner surface of the collecting exhaust pipe that is adjacent to the downstream portion of the exhaust port connected to the combustion chamber of the first cylinder, is larger than the second concave portion located in a region that is adjacent to the downstream portion of the exhaust port connected to the combustion chamber of each of the other cylinders.

10. The vessel propulsion apparatus according to claim 1, wherein the first concave portion and the second concave portion define to direct the exhaust gases in the plurality of connector portions in the downstream direction.

11. The vessel propulsion apparatus according to claim 1, wherein the engine includes a crankshaft extending along a vertical direction; and the vessel propulsion apparatus includes an outboard motor including a drive shaft connected to the crankshaft and extending along the vertical direction, a propeller shaft extending along a horizontal direction, a propeller functioning as the propulsion unit and connected to the propeller shaft, and a transmission to transmit rotation of the drive shaft to the propeller shaft.

12. A vessel comprising:

a hull; and the vessel propulsion apparatus according to claim 1 mounted to the hull to provide a thrust to the hull.

13. A vessel engine comprising:

a plurality of cylinders arranged in series and each including a combustion chamber;

a plurality of exhaust ports respectively connected to the combustion chambers of the plurality of cylinders and curved in a predetermined downstream direction of a flow of exhaust gases to allow the exhaust gases to flow out from the combustion chambers;

a collecting exhaust pipe integral with the plurality of exhaust ports and extending in the downstream direction to allow the exhaust gases in the exhaust ports to flow in the downstream direction; and a plurality of connector portions that individually connect the plurality of exhaust ports to the collecting exhaust pipe, and each of the plurality of connector portions including a first concave portion at an inner surface thereof and a second concave portion located in a region of an inner surface of the collecting exhaust pipe, and the first concave portion and the second concave portion do not extend through the plurality of connector portions.

14. An exhaust structure for a vessel engine, the exhaust structure comprising:

a plurality of exhaust ports respectively connected to combustion chambers of a plurality of cylinders arranged in series and curved in a predetermined downstream direction of a flow of exhaust gases to allow the exhaust gases to flow out from the combustion chambers;

a collecting exhaust pipe integral with the plurality of exhaust ports and extending in the downstream direction to allow the exhaust gases in the plurality of exhaust ports to flow in the downstream direction; and a plurality of connector portions that individually connect the plurality of exhaust ports to the collecting exhaust pipe, and each of the plurality of connector portions including a first concave portion at an inner surface thereof and a second concave portion located in a region of an inner surface of the collecting exhaust pipe, and the first concave portion and the second concave portion do not extend through the plurality of connector portions.

* * * * *